US012710250B2

(12) United States Patent
Fuller

(10) Patent No.: US 12,710,250 B2
(45) Date of Patent: Aug. 18, 2026

(54) DOVETAIL REFLEX SIGHT AND INTERFACE FOR MOUNTING TO A FIREARM

(71) Applicant: David Malcolm Fuller, Bowral (AU)

(72) Inventor: David Malcolm Fuller, Bowral (AU)

( * ) Notice: Subject to any disclaimer, the term of this patent is extended or adjusted under 35 U.S.C. 154(b) by 29 days.

(21) Appl. No.: 18/541,707

(22) Filed: Dec. 15, 2023

(65) Prior Publication Data

US 2024/0200908 A1 Jun. 20, 2024

Related U.S. Application Data

(60) Provisional application No. 63/432,784, filed on Dec. 15, 2022.

(51) Int. Cl.
*F41G 11/00* (2006.01)
*F41G 1/30* (2006.01)

(52) U.S. Cl.
CPC ..... *F41G 11/003* (2013.01); *F41G 1/30* (2013.01)

(58) Field of Classification Search
CPC ..... F41G 1/30; F41G 11/001–008; F41G 1/16–28; F41G 1/033
See application file for complete search history.

(56) References Cited

U.S. PATENT DOCUMENTS 1,837,290 A * 12/1931 Redfield ..... F41G 11/006 42/127
2,079,266 A * 5/1937 Vaver ..... F41G 1/033 42/127
2,306,972 A * 12/1942 Meisel ..... F41G 11/006 248/694
4,367,606 A * 1/1983 Bechtel ..... F41G 11/003 D22/110
4,691,442 A * 9/1987 Center ..... F41G 1/17 42/137
4,929,973 A * 5/1990 Nakatani ..... F16M 11/041 396/419
6,327,806 B1 * 12/2001 Paige ..... F41G 1/30 42/130
8,087,196 B2 * 1/2012 Jung ..... F41G 1/20 42/122
9,062,936 B2 * 6/2015 Zimmer ..... F41C 3/00
9,151,575 B2 * 10/2015 Pereira ..... F41C 23/12
9,303,955 B2 * 4/2016 Jeung ..... F41G 1/30
9,453,706 B1 * 9/2016 Crispin ..... F41G 1/26
9,506,726 B2 * 11/2016 Wolf ..... F41G 1/26
9,574,853 B2 * 2/2017 Crispin ..... F41G 11/007
10,024,628 B2 * 7/2018 Toner ..... F41G 1/16
(Continued)

*Primary Examiner* — Joshua E Freeman
(74) *Attorney, Agent, or Firm* — Ian Burns; Darren Gardner; American Law, LTD

(57) ABSTRACT

To allow a reflex sight to be mounted to the slider of a handgun and removed without the need for tools, an adapter shoe may be secured to the slider to provide an interface between an optics-ready recess of the slider and a mounting element that forms part of the reflex sight assembly. The adapter shoe may provide a dovetail track that engages complementary dovetail features of the mounting element. A push button retention mechanism may be biased to lock the mounting element within the adapter shoe. Actuation of the push buttons may retract the retention mechanism and allow the reflex sight assembly to slide out of the dovetail track.

12 Claims, 11 Drawing Sheets

(56) References Cited

U.S. PATENT DOCUMENTS 10,240,901 B1 * 3/2019 Cheng ..... F41A 35/00
10,563,955 B2 * 2/2020 Pniel ..... F41G 1/16
10,782,099 B2 * 9/2020 Zimmer ..... F41G 11/006
10,871,351 B2 * 12/2020 Becker ..... F41H 1/02
10,948,267 B2 * 3/2021 Zimmer ..... F41G 11/006
11,002,517 B1 * 5/2021 Holly ..... F41G 1/30
11,112,214 B2 * 9/2021 Niswander ..... F41G 11/001
11,300,382 B2 * 4/2022 Holly ..... F41G 11/002
11,454,474 B2 * 9/2022 Zimmer ..... F41G 11/006
11,460,274 B2 * 10/2022 Dawson, Jr. ..... F41G 11/001
11,644,280 B2 * 5/2023 Langdon ..... F41G 1/16 29/401.1
11,788,818 B2 * 10/2023 Roth ..... F41G 11/001 42/113
11,933,583 B2 * 3/2024 Niswander ..... F41G 11/001
11,959,727 B1 * 4/2024 Yedor ..... F41G 11/003
12,235,078 B2 * 2/2025 Planck ..... F41G 11/001
2010/0083554 A1 * 4/2010 Elpedes ..... F41G 1/30 42/130
2013/0219767 A1 * 8/2013 Peterson ..... F41G 11/003 29/428
2014/0230305 A1 * 8/2014 Zimmer ..... F41C 3/00 42/111
2014/0305022 A1 * 10/2014 Chung ..... F41G 1/387 42/113
2015/0192389 A1 * 7/2015 Reichert ..... F41G 1/30 42/130
2015/0268002 A1 * 9/2015 Jeung ..... F41G 1/30 42/71.02
2016/0209175 A1 * 7/2016 Sharron ..... F41G 11/003
2017/0059277 A1 * 3/2017 Justice ..... F41G 11/003
2017/0211910 A1 * 7/2017 Olmsted ..... F41G 1/35
2017/0261288 A1 * 9/2017 Bartoszewicz ..... F41G 11/003
2018/0202770 A1 * 7/2018 Pniel ..... F41G 1/16
2019/0257620 A1 * 8/2019 Zimmer ..... F41C 3/00
2019/0331461 A1 * 10/2019 Zimmer ..... F41G 1/17
2020/0025520 A1 * 1/2020 Niswander ..... F41G 11/003
2020/0240748 A1 * 7/2020 Connolly ..... F41G 1/387
2020/0326157 A1 * 10/2020 Curry ..... F41A 21/484
2021/0025673 A1 * 1/2021 Niswander ..... F41G 1/30
2021/0116213 A1 * 4/2021 York ..... H01M 50/247
2021/0270572 A1 * 9/2021 Dawson, Jr. ..... F41G 11/001
2021/0318099 A1 * 10/2021 Holly ..... F41G 11/002
2022/0034631 A1 * 2/2022 Rosen ..... F41G 11/003
2022/0136802 A1 * 5/2022 Toy ..... G02B 27/34 42/113
2022/0268553 A1 * 8/2022 Roth ..... F41G 11/001
2023/0213315 A1 * 7/2023 Planck ..... F41G 11/003 42/111
2023/0258430 A1 * 8/2023 Zheng ..... F41G 11/001 403/321
2024/0077281 A1 * 3/2024 Contessa ..... F41G 1/16
2024/0110769 A1 * 4/2024 Underwood ..... F41G 11/003
2025/0020437 A1 * 1/2025 Renaud ..... F41G 11/006

* cited by examiner

DOVETAIL REFLEX SIGHT AND INTERFACE FOR MOUNTING TO A FIREARM

CROSS REFERENCE TO RELATED APPLICATIONS

This application claims priority to U.S. provisional patent application No. 63/432,784 filed 15 Dec. 2022, the entire contents of which are incorporated herein by reference.

FIELD OF THE INVENTION

The present invention relates to sights for use on firearms, in particular handguns having a slider element.

BACKGROUND

Reflex sights have been common as an aid to sighting of a firearm. In a reflex sight, a prior art example of which is shown generally at 100 in FIG. 1, a light spot from a light source such as a light emitting diode (LED) is projected onto a lens 110. The lens reflects the light spot back to the eye of the firearm user who, looking through the lens, uses the light spot as a centering aiming mark for targeting.

The typical components of a reflex sight include a lens 110, light source (LED), windage and elevation adjustments, battery, controls and housing for these. A common arrangement that provides the most common sight is to have the battery, controls and windage adjustments in a lower housing 120 with the lens 110 and LED resting on top. The entire reflex sight can then be mounted on top of the firearm. For battery change many reflex sights require access to the battery compartment through the bottom plate 124.

Unlike a rifle or long barrel firearm which include no upper moving parts, the upper part of a pistol-type handgun includes a moving slider that facilitates reloading of the firearm, either manually or automatically. The slider presents an issue for top mounted sights. It is most simple to directly mount the reflex sight to the slider. A direct mount has the advantage that the sight has a low mounting position meaning that the line of sight most accurately aligns with the line of the barrel, reducing any parallax errors. Slider mounted sights are compact and have simple mountings employing screws or a combination of screws plus pins or other kinds of mechanical stoppers.

In order to further lower the sighting line, modern firearms are featuring so-called "optics-ready" sliders with rectangular recesses, to allow for embedded mounting of sights. An embodiment of a prior art optics-ready slider is shown in FIG. 2. The slider 200 includes a recess 210 formed into the top surface 212 of the slider. One or more screw holes 216 may be pre-formed for receiving a reflex sight mount. FIG. 3 shows a schematic side view of a prior art reflex sight 100 mounted into the recess 210 to an optics-ready slider 200 and secured in the recess 210 by a screw 218. Such recess-fitted sliders are a favorable solution, as the now much lower mounting allows for aiming through the optical sight while at the same time still being able to see the front and rear mechanical sights of the firearm.

Due to the extreme acceleration of the slider during shooting, state-of-art reflex sights are securely connected to the slider by means of screws or a combination of screws plus pins or other mechanical stoppers. This may additionally include an adapter plate to accommodate the numerous different mounting standards.

A disadvantage of state-of-art reflex sight is that the reflex sight can only be mounted to or taken off from the slider by means of tools like screwdrivers or wrenches. Taking the reflex sight off easily through hand-operated, tool-free operation may be desirable when the shooting situation changes, the reflex sight fails or access to the bottom plate for change of battery is required.

Another disadvantage of the present mounting solution is that the slider must be fitted with screw holes to match the mounting geometries of state-of-art reflex sights. The acceleration stress has to be carried solely by one or more screws, while the sight housing itself is not absorbing any of the applied force.

What is required is an improved mounting system for a firearm sight.

SUMMARY OF ONE EMBODIMENT OF THE INVENTION

Advantages of One or More Embodiments of the Present Invention

The various embodiments of the present invention may, but do not necessarily, achieve one or more of the following advantages:

- provide a reflex sight for firearms in shape that is becoming functional as a mounting element to connect with a gun slider without use of joining elements;
- ability to mount and detach the reflex sight without use of tools;
- ability to absorb shock across a significant surface of the housing instead of joining elements such as pins or screws;
- ability to adjust the fit of the reflex sight to the slider by means of an adjustable clamp plate;
- ability to minimize the machining cost of a gun slider by simplifying the machining process.

These and other advantages may be realized by reference to the remaining portions of the specification, claims, and abstract.

BRIEF DESCRIPTION OF ONE EMBODIMENT OF THE PRESENT INVENTION

In one aspect of the present invention, there is provided a reflex sight that is removably mountable to a slider of a handgun. The reflex sight may comprise a lens, a light source, a battery for powering the light source and electronics for controlling the operation of the light source. One or more of these components may be housed in a housing. A mounting element may be configured to mount the reflex sight to the slider. The mounting element may comprise a sight mounting component and an adapter shoe. The sight mounting component may comprise a sight mounting surface on which the reflex sight may be mounted and secured and a first complementary engagement feature. The adapter shoe may comprise a first mounting portion for mounting the adapter shoe to the slider and a second mounting portion comprising a second complementary engagement feature that is complementary to the first complementary engagement feature.

In one aspect of the present invention, there is provided sighting system for a firearm comprising a reflex sight, a slider and a mounting element. The reflex sight may comprise a lens, a light source, a battery for powering the light source and electronics for controlling the operation of the light source. One or more of these components may be housed in a housing. The slider may be configured to be mounted on a firearm and to slide along the longitudinal barrel. The slider may comprise a recess. The mounting element may be configured to mount the reflex sight into the recess of the slider such that the reflex sight can be removed from the slider without tools.

In one aspect of the present invention, there is provided adapter shoe configured to be mounted to a slider of a handgun to adapt the slider to receive a removable reflex sight. The adapter shoe may comprise a first mounting portion for mounting the adapter shoe to the slider, and a second mounting portion comprising a first complementary engagement feature that is complementary to a second complementary engagement feature of the reflex sight.

In one aspect of the present invention, there is provided a method for mounting a reflex sight to a handgun. The method may comprise securing an adapter shoe to a slider of the handgun. The adapter shoe may comprise a first mounting portion for mounting the adapter shoe to the slider, and a second mounting portion comprising a first complementary engagement feature that is complementary to a second complementary engagement feature of the reflex sight. A reflex sight assembly comprising the reflex sight may be moved into engagement with the adapter shoe by engaging the first complementary engagement feature with a second complementary engagement feature of the reflex sight assembly.

In one aspect of the present invention, there is a provided a sighting system for a firearm comprising a reflex sight and a slider of the firearm. The reflex sight may comprise a housing, a lens, a light source, battery and electronics. The reflex sight may be mounted to the slider by a mounting element. The mounting element may comprise a first mounting portion and a second mounting portion above the first portion. The first mounting portion may be longer than the second mounting portion in a longitudinal direction of the firearm. The slider may comprise a recess that receives the mounting element. The recess may comprise a first recess portion and a second recess portion. The first recess portion may be longer than the second recess portion in a longitudinal direction of the firearm and may be configured to receive and accommodate the first mounting portion when the reflex sight is mounted to the slider.

In one aspect of the present invention, there is provided a reflex sight for a firearm. The reflex sight may comprise a housing, a lens, a light source, battery and electronics. The reflex sight may be mounted to the slider by a mounting element. The mounting element may comprise a first mounting portion and a second mounting portion above the first portion. The first mounting portion may be longer than the second mounting portion in a longitudinal direction of the firearm.

In one aspect of the present invention, there is provided a slider for a firearm. The slider may comprise a recess that receives a mounting element of a reflex sight. The recess may comprise a first recess portion and a second recess portion. The first recess portion may be longer than the second recess portion in a longitudinal direction of the firearm and may be configured to receive and accommodate the first mounting portion when the reflex sight is mounted to the slider.

The above description sets forth, rather broadly, a summary of one embodiment of the present invention so that the detailed description that follows may be better understood and contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF CERTAIN EMBODIMENTS OF THE PRESENT INVENTION

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

The embodiments to be described herein provide a reflex sight that can be quickly and easily detached or mounted to a slider of a firearm. In one or more embodiments, the interface between the reflex sight and the slider may allow for the reflex sight to be mounted and removed by hand i.e.

without the substantial use of tools. In particular, the reflex sight may be secured without particular fasteners such as screws that would require screwdrivers, hex keys or the like to remove.

Figure 4:
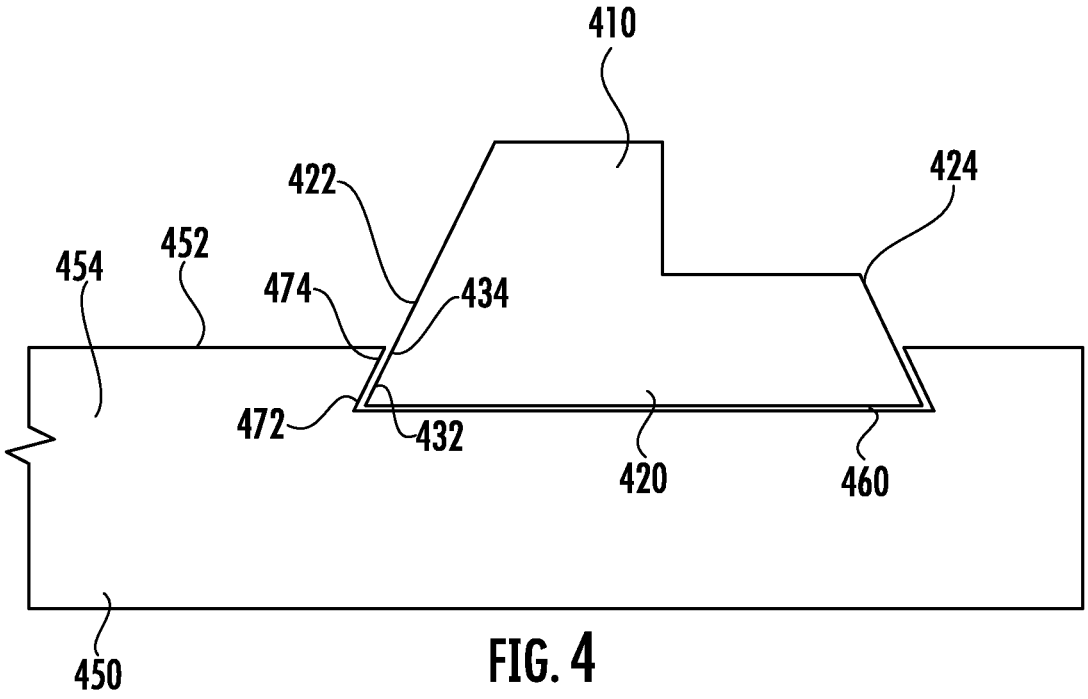
FIG. 4 substantially shows a reflex sight in accordance with an embodiment of the present invention, mounted to a firearm.

FIG. 4 shows a first embodiment of an interface between a slider portion of a firearm and a reflex sight. For the embodiments to be described, the reflex sight may be considered a state of the art sight in which all functional optical, mechanical elements are integrated within a housing. However, the specific arrangement of components of the sight is not pertinent for the present invention. For the present embodiments however, the reflex sight may have a modified form factor that can become a functional element of the mounting interface. Specifically, the lower part of the reflex sight 410 may include a tapered mounting element 420. The tapered mounting element is continuous with and integral to the housing of the sight, particularly the lower housing portion that houses the battery and electronics. As shown in the side view of FIG. 4, the sight 410 may include a forward sloping edge 422 and a rear sloping edge 424 that both slope outwardly in the direction from top to bottom of the sight, giving the mounting element a dovetail profile in side view. That is, the bottom portion 432 of the mounting element is the longest portion of the sight and is longer than the upper portion of the mounting element 434.

The slider is a component of the firearm that slides in the longitudinal direction back and forth along the barrel of the firearm to facilitate loading and re-loading of the firearm, either manually, semi-automatically, or automatically. Various sliders exist and are typically specific to the firearm. The particular slider is not considered pertinent to the present disclosure and all manner of sliders may be suitable for use in the embodiments to be described. That is, a slider that may be considered conventional or standard slider may be modified to include a complementary dovetail track running perpendicular to the firearm bore cut into or attached to the slider. As shown in FIG. 4, the slider 450 includes a slider body 452 having a top face and sidewalls 452. The dovetail recess or track 460 is cut through a first sidewall 452 of the slider and runs perpendicular to the longitudinal direction of the slider and the firearm. The dovetail track 460 may extend all of the way through to the opposite sidewall enabling the sight to be mounted from either side. Alternatively, the dovetail track may be cut from only one sidewall of the slider and extend laterally into the slider only so far as to allow the sight to be substantially centrally mounted within the slider.

The dovetail track 460 of the slider is complementary to the dovetail mounting element 420 of the reflex sight. That is, the track has a longer lower portion 472 and a shorter upper portion 472 and can laterally receive the tapered mounting element of the sight. By sliding the reflex sight sideways through the sidewall into the fitting rail of the slider, the sight can be securely held in place by friction grip. Because the sight is received laterally into the channel, e.g. moving from the side of the slider laterally to centered on the slider (moving perpendicular to the bore of the firearm), the friction grip of the slider/sight dovetail interface does not allow any substantial forward or rearward movement during acceleration of the firearm during shooting. Provided a tight fit, the reflex sight does not require any securing against acceleration in the movement direction of the slider during firing.

Figure 5:
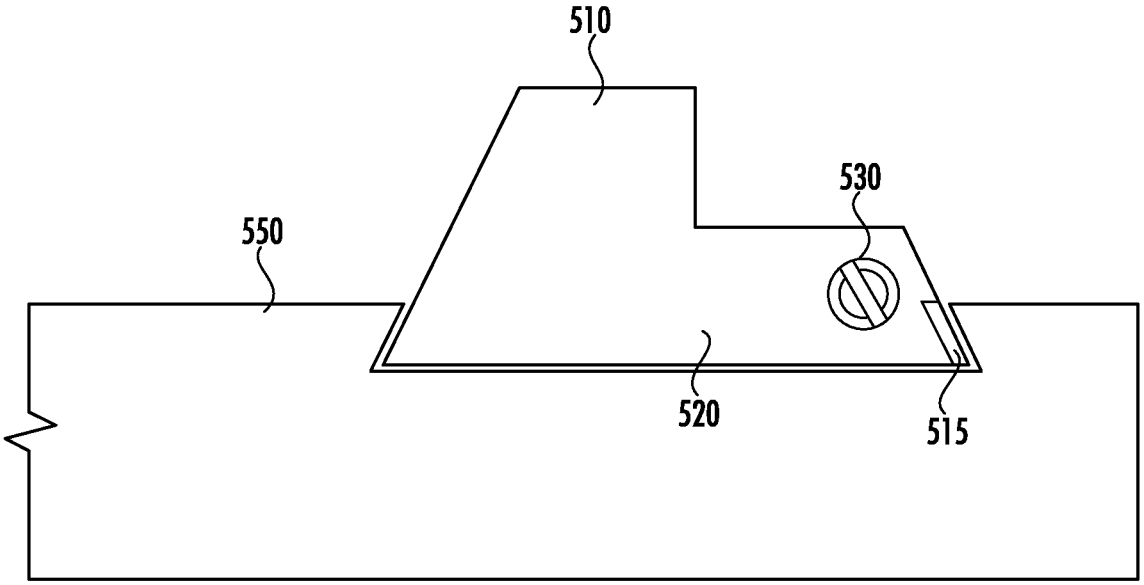
FIG. 5 substantially shows a reflex sight in accordance with an embodiment of the present invention, mounted to a firearm, comprising an adjustable clamp plate retracted.
Figure 6:
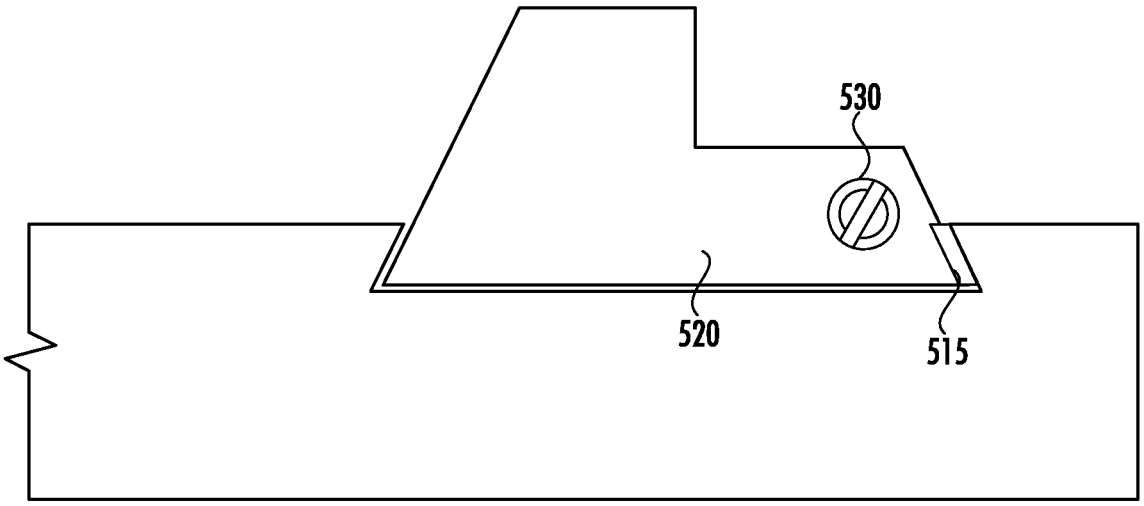
FIG. 6 substantially shows a reflex sight in accordance with an embodiment of the present invention, mounted to a firearm, comprising an adjustable clamp plate extended.

FIGS. 5 and 6 show a modification of the mounting element of FIG. 4. In FIG. 5, the dovetail mounting element of the sight 510 includes an adjustable clamp plate 515 disposed in the rearward sloping edge 524 of the mounting element. The clamp plate 515 has a matching sloping edge that can extend longitudinally outward of the rearward sloping edge to extend the length of the mounting element. The extension of the clamp plate 510 may be controlled by a fastener, such as a turn screw 530 mounted on the side of the sight. Rotation of the turn screw by hand force in one direction, e.g. anticlockwise may cause retraction of the adjustable clamp plate into the body of the mounting element 520 (FIG. 5), thereby making insertion of the mounting element into the dovetail track easier. Once the sight is mounted in the slider 550, rotation of the turn screw in the opposition direction, e.g. clockwise, can cause extension of the clamp plate outward of the mounting element (FIG. 6) to increase the friction engagement with the corresponding surface of the dovetail track thereby more securely holding the sight in place in the slider. As the clamping plate 515 extends, the sloping interface causes both longitudinal and downward bracing of the mounting element within the slider track, providing a multi-directional friction engagement. In one particular embodiment, the clamp plate is pressed against the slider's dovetail track by means of a fastening operating element that rotates a cam shaft to extract and retract the clamp plate. In the shown embodiment the extracting clamp plate forces the housing forward into slider's dovetail track and downwards towards the mounting base, thus ensuring maximum precision and repeatability when mounting the reflex sight. The fastening mechanism allows for adjustment of the semi-permanent friction fit thus making detachment of the reflex sight very easy and the fit very tight when secured. The turn screw is preferably hand operated so that the sight can be installed and removed without tools. However, if required for increasing the retention force, the screw may be tool operated. In one embodiment, the clamping plate 515 may be spring-loaded and biased to the extended position.

Figure 7:
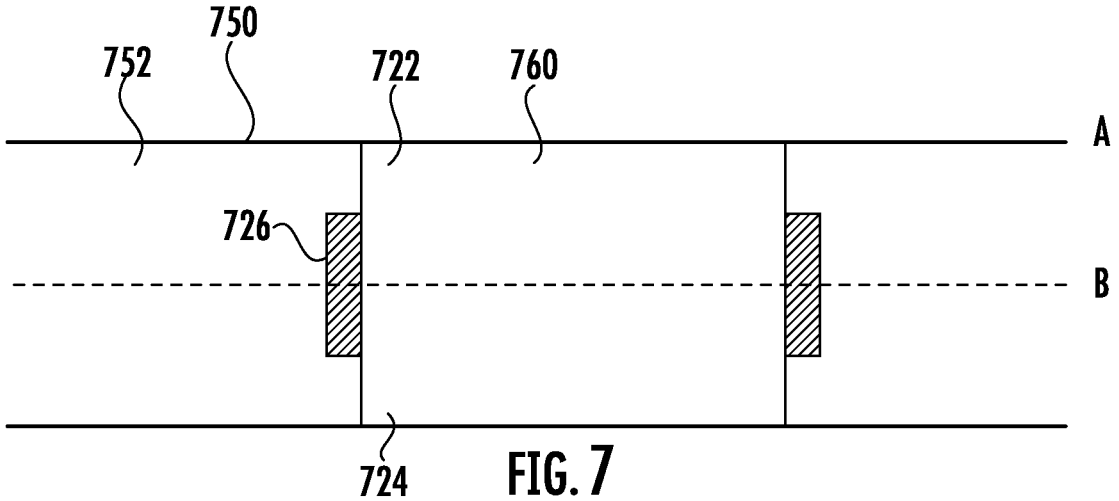
FIG. 7 substantially shows a top schematic view of a slider recess in an alternative embodiment.
Figure 8:
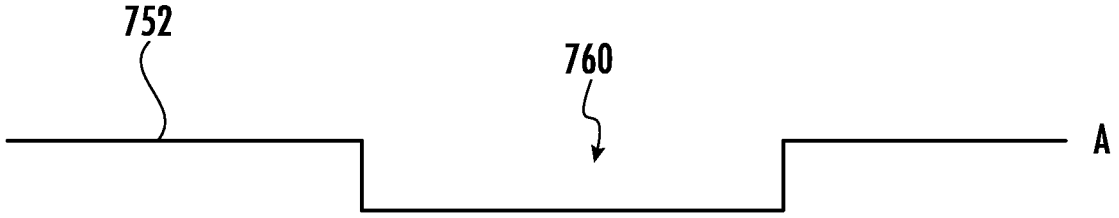
FIG. 8 substantially shows a side view of the slider at an edge A from FIG. 7.
Figure 9:
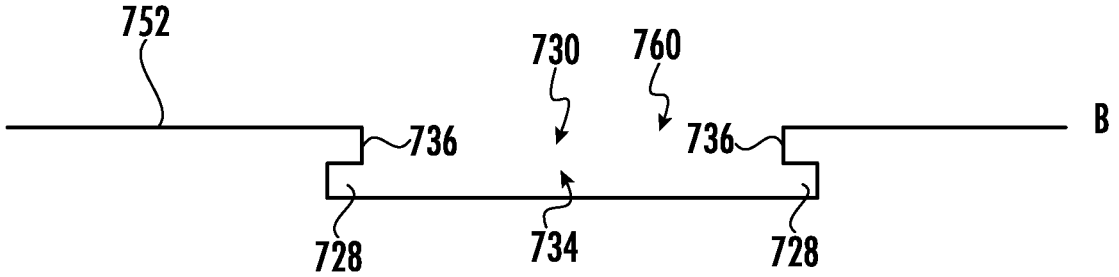
FIG. 9 substantially shows a side view of the slider through a centerline section B from FIG. 7.

FIGS. 7 to 9 show an alternative embodiment of the slider/sight mounting interface. FIG. 7 shows a top view of a slider 750 with a recess formed 760 in the top surface 752 that provides a track for a mounting element of a reflex sight. In this embodiment, the slider track 760 has lateral edge portions 722, 724 of a first length in the bore direction and a central portion 726 between the lateral edge portions 722, 724 in which the upper part 730 of the track has the same first length but the lower portion 734 of the track has a second, longer length, thereby defining cutouts 728. A lip 736 is defined between the upper and lower portions. The lip may be square, rounded, beveled, or other shapes as desired. In the particular embodiment of FIGS. 7-9, the lip is shown as square. A mounting element of a sight for engaging the mounting interface of FIGS. 7-9 may include a square front and rear face. The mounting element may engage the slider track 760 by means described above including by high resistance sliding with locking by simple friction grip, by loose sliding (low resistance) together with expanding elements, or by moving the sight into the recess 760 and locking by force closure such as by expanding element extending into the cut outs 728. The expanding elements may be actuated by a turn screw or may be spring loaded and biased to the extended position.

The embodiment of FIGS. 7-9 show a lip at each longitudinal end of the slider track. However, in alternative embodiments, retention of the mounting element and sight may require only a single lip at one longitudinal end of the track.

A further embodiment of a reflex sight mounting system is depicted in FIGS. 10 to 15. In this embodiment, the mounting element is a two-component system which includes a sight mounting component to which the reflex sight is mounted and an adapter shoe component that may be secured to the handgun slider. The adapter shoe provides an intermediate interface between the slider and the sight mounting component. The sight mounting component and the adapter shoe each have complementary engagement features, such as complementary dovetail elements to enable the sight mounting component and the adapter shoe to engage each other. A retention mechanism may be used to lock the sight mounting component to the adapter shoe. The retention mechanism may be biased to a retention position but may be actuatable without tools, e.g. by push buttons, to unlock the retention mechanism to allow the sight mounting component to be removed from the adapter shoe.

Figure 10:
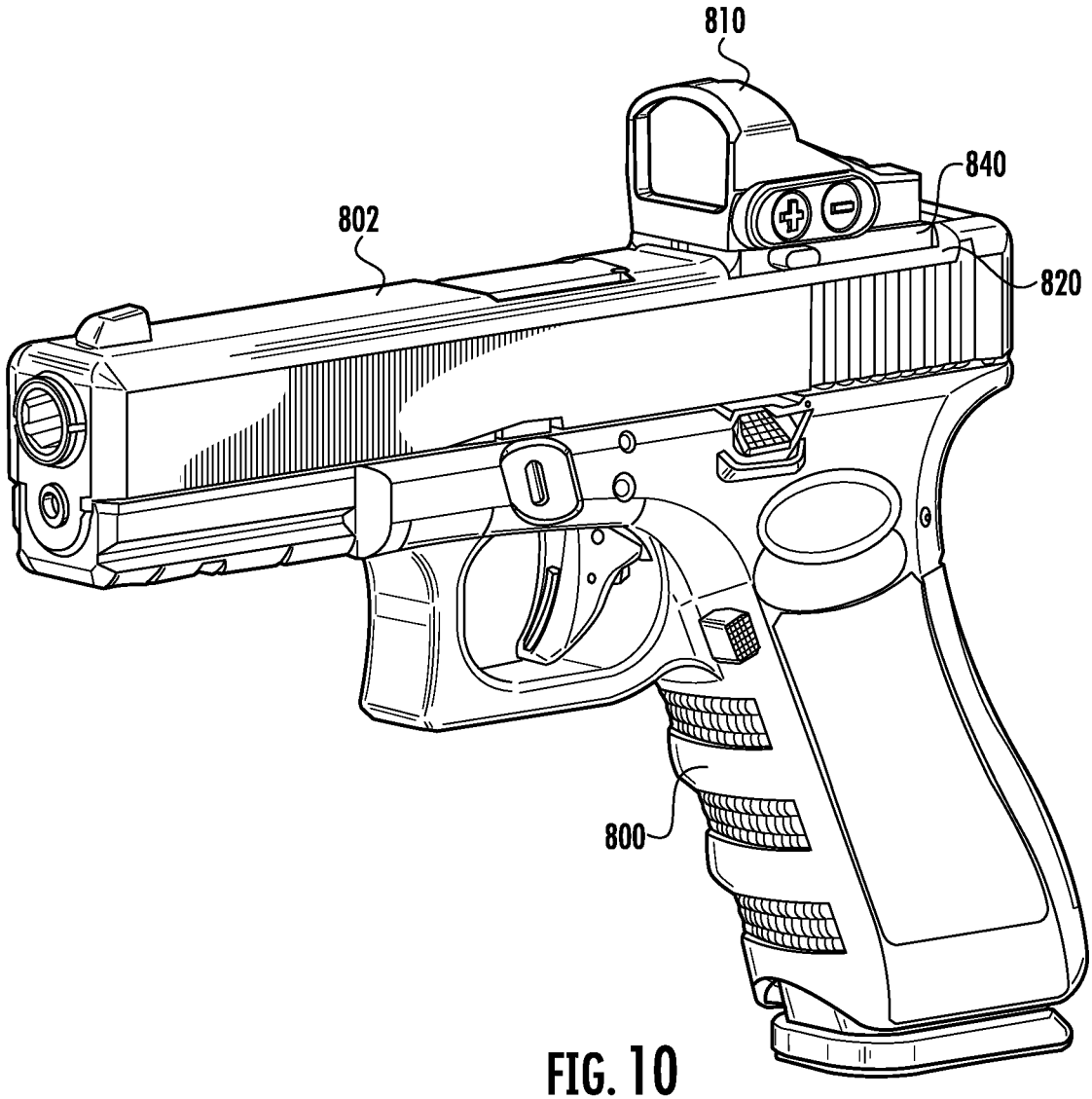
FIG. 10 substantially shows a handgun with a reflex sight assembly of an alternative embodiment.
Figure 11:
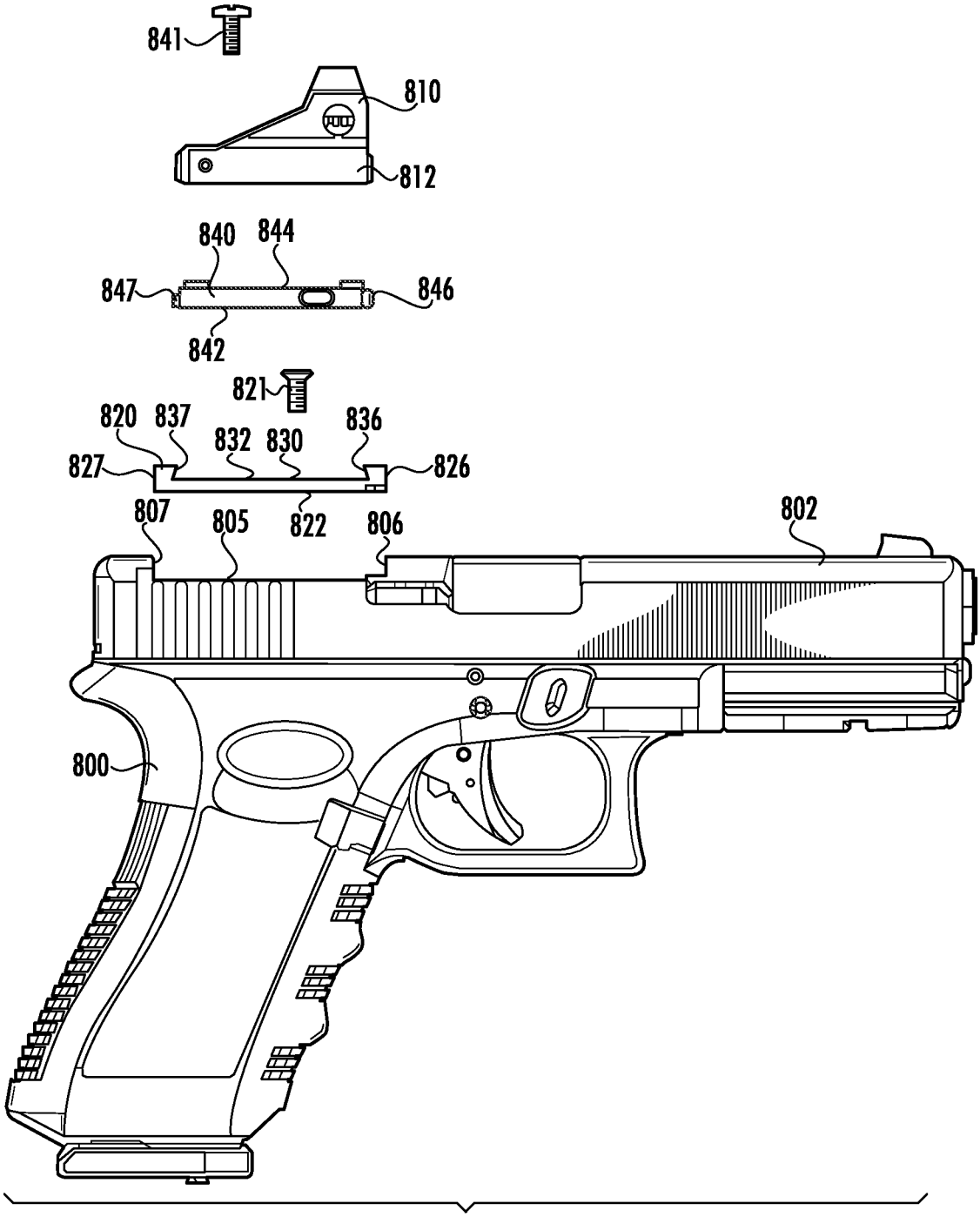
FIG. 11 substantially shows an exploded view of the handgun, adapter shoe, sight mounting component and reflex sight of FIG. 10.

FIG. 10 shows a handgun 800 with a reflex sight assembly, including a reflex sight 810 and sight mounting element 840 mounted to the handgun slider 802 via an adapter shoe 820. FIG. 11 shows an exploded view of the handgun 800, reflex sight 810 and slider 802.

Figure 1:
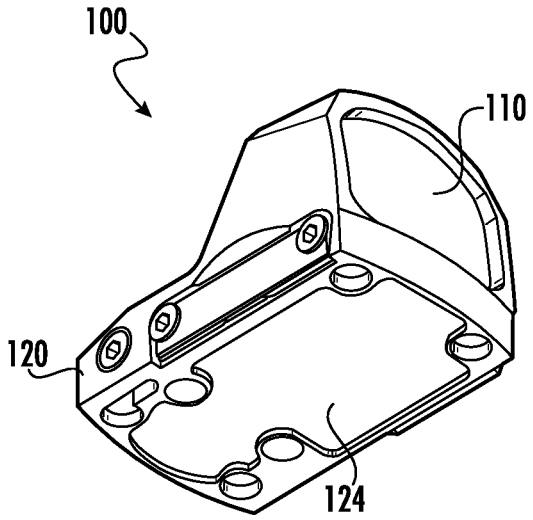
FIG. 1 (PRIOR ART)
FIG. 1 substantially shows an example of a prior art reflex sight.
Figure 2:
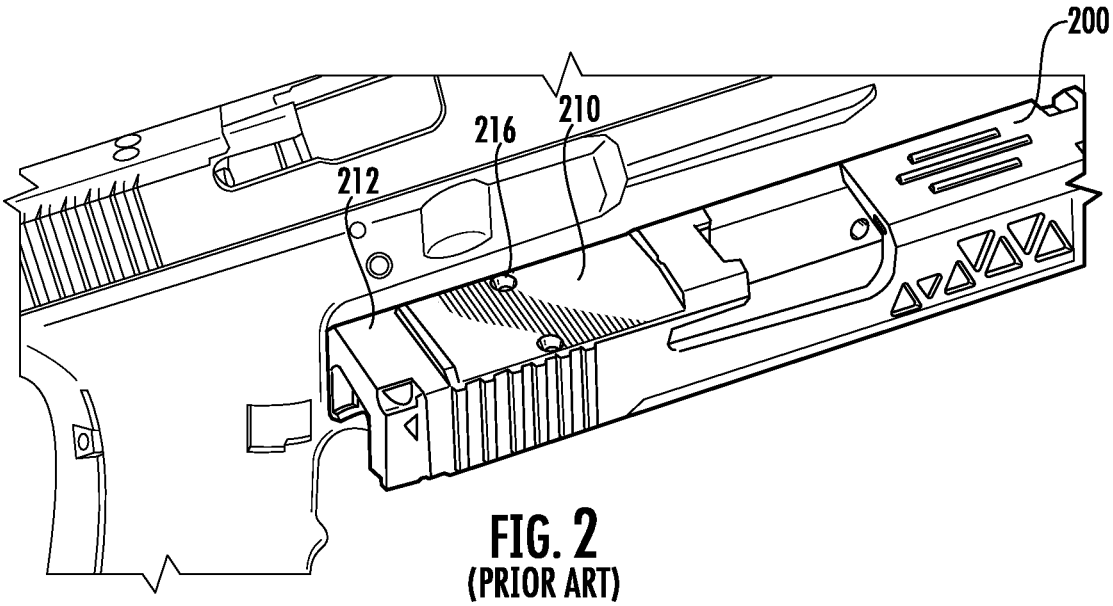
FIG. 2 (PRIOR ART)
FIG. 2 substantially shows a prior art slider interface for prior art reflex sight mounting.
Figure 3:
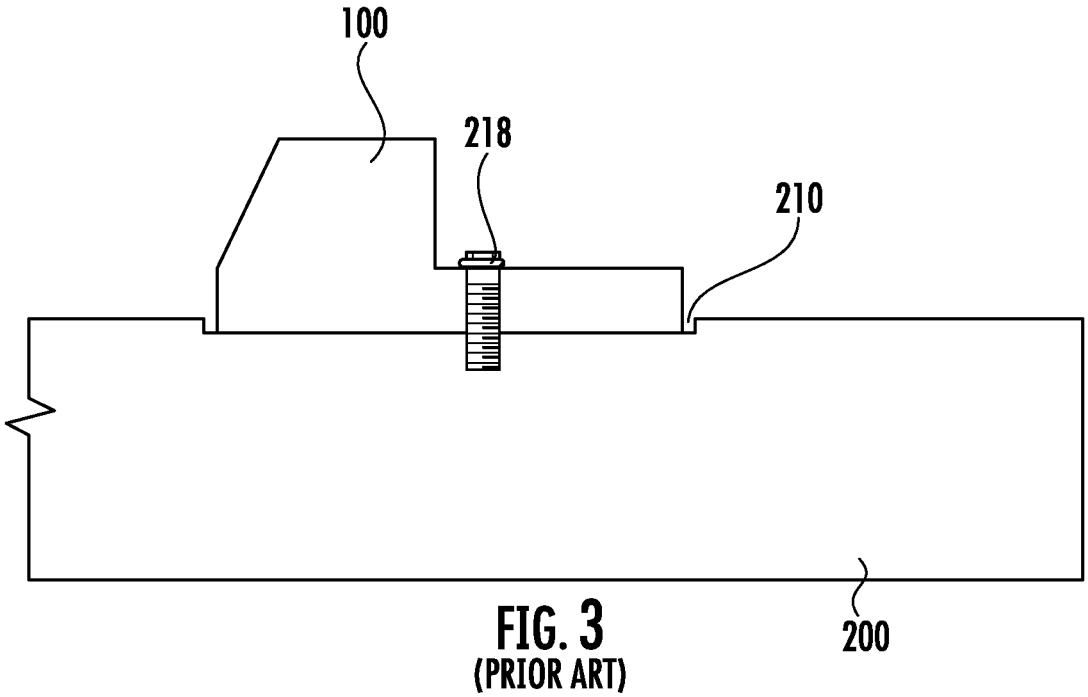
FIG. 3 (PRIOR ART)
FIG. 3 substantially shows a schematic side view of a prior art reflex sight, mounted on a firearm.
Figure 12:
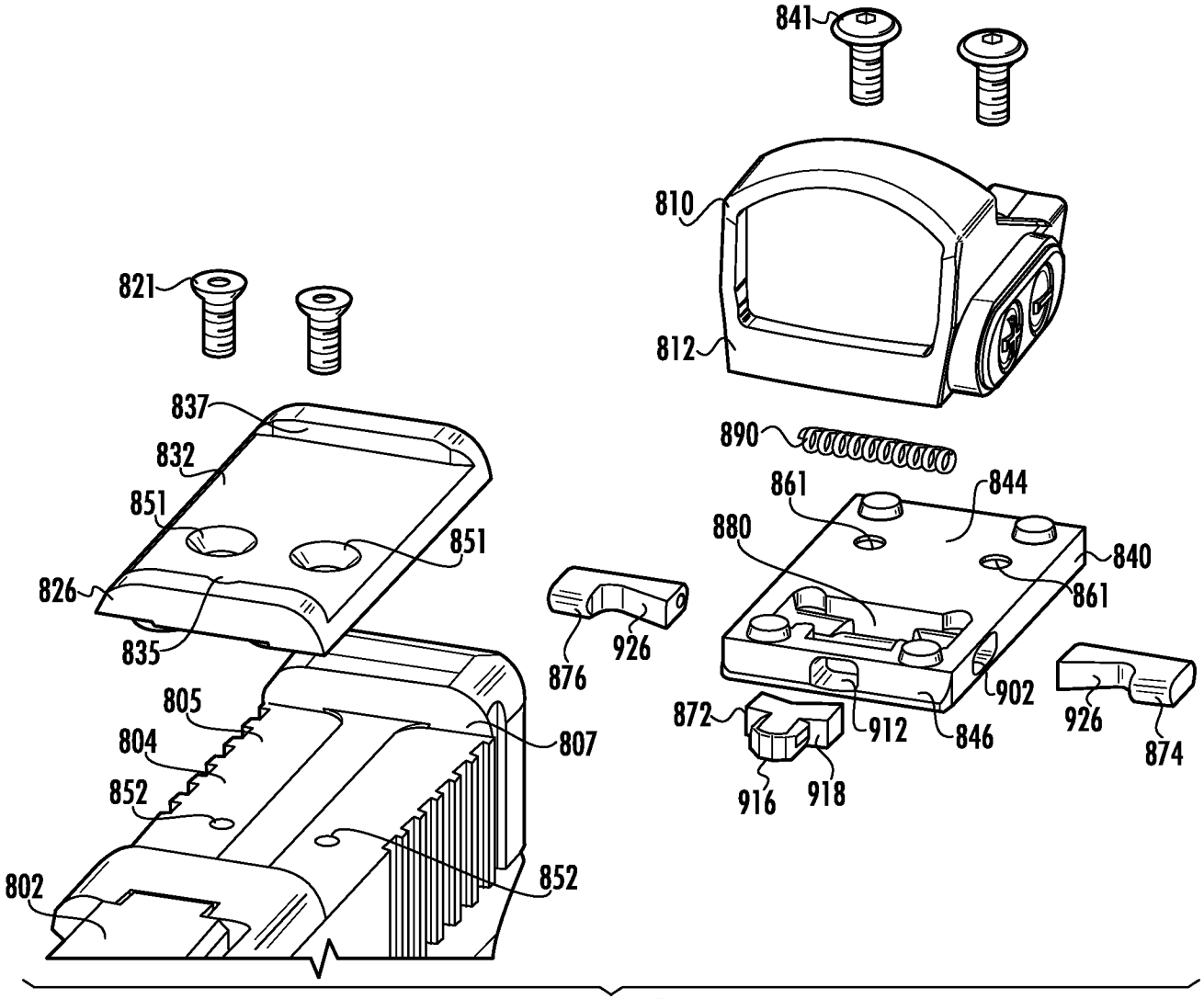
FIG. 12 substantially shows a further exploded view of the adapter shoe and sight mounting component of FIG. 11.

FIG. 10 shows the assembled handgun 800 with slider 802 and removable reflex sight 810 mounted to the slider via the sight mounting component 840 and the adapter shoe 820. FIG. 11 shows an exploded view of the handgun 800 with slider 802, reflex sight 810, sight mounting component 840 and adapter shoe 820. FIG. 12 shows a further exploded view of the reflex sight 810 and adapter shoe 820. The adapter shoe 820 may be used with a standard slider or a slider that has been modified to accept the adapter shoe 820. In particular, the adapter shoe 820 may provide a square outer mounting that may complement a square recess 804 of the slider 802, such as the prior art sliders depicted in FIGS. 2 and 3, while providing a dovetail inner mounting for complementary engagement with a dovetail element of the sight mounting component 840. The adapter shoe 820 is secured to the slider by one or more fasteners 821, such as screws in a permanent or semi-permanent manner such that the adapter shoe is maintained as a fixture on the slider. The reflex sight assembly (reflex sight 810 and sight mounting component 840) may be removably inserted into the adapter shoe 820 and secured in place by a tool-less retention mechanism. The retention mechanism may be selectively actuatable, e.g. by single handed operation of push buttons to remove the dovetail element and reflex sight from the adapter shoe, thereby removing the sight from the slider.

The slider 802 of the handgun includes a recess 804. The recess 804 may be formed during the manufacture of the handgun and/or slider. Alternatively, the recess may be formed as an after-market modification of the slider 802. The recess 804 as shown is generally square, i.e. having substantially square corners between a flat base 805 and vertical walls 806, 807. Unlike the earlier described embodiments, the firearm slider itself does not carry the dovetail geometry for direct mounting of the reflex sight 810 to the slider 802. An adapter shoe 820 is thus provided. The adapter shoe 820 comprises a body with a generally square outer profile that is sized and shaped to complement the shape of the recess 804. The profile includes a flat lower surface 822 of the base of the body, vertical end walls 826, 827 and square outer corners at the outer junction of the base 822 and the end walls 826, 827.

The body of the adapter shoe also defines a recess 830 in the upper side of the body. The recess has an inner dovetail profile formed by inwardly angled end walls of the 836, 837 of the recess 830. That is, the recess has a flat base 832 at an upper surface of the adapter shoe body. Projecting upward of the flat base 832 are end walls 836, 837. The end walls 836, 837 angle inwardly from the base, thus forming an acute angle at the corners where the end walls meet the base 832. The body may include one or more fastener holes 851 that align with threaded fastener holes 852 in the recess 804 of the slider 802. The holes 851 may be countersunk. The adapter shoe 820 may be secured into the recess 804 of the slider 802 using fasteners 821 into the fastener holes 851/852 of the adapter shoe 820 and the slider 802. The fit of the adapter shoe within the slider recess does not need to be a snug fit because the retention of the adapter shoe is provided by the fasteners. However, a snug fit may be more aesthetically pleasing. The forward end wall 836 may include one or more notches 835.

The reflex sight 810 comprises the reflex sight elements as described above, i.e. a light source, lens, battery, control electronics and control buttons as described previously provided within a reflex sight housing 812. The reflex sight housing 812 may be secured to a mounting element 840 which is provided as a separate component to the reflex sight 810. The mounting element 840 may be specifically customized for use with the adapter shoe 820. The mounting element may comprise a body having a lower surface 842 that, in use, abuts the upper surface of the recess 832 of the adapter shoe. The body may also comprise end walls 846, 847 that form acute inner angles with the lower surface 842 to match the dovetail corners of the recess of the adapter shoe. The size and shape of the mounting element is configured to nestle snugly with the size and shape of the recess of the adapter shoe.

The mounting element body may provide an upper mounting surface 844 for mounting the housing 812 of the reflex sight 810. The upper mounting surface 844 may include threaded mounting holes 861 for receiving threaded fasteners 841, e.g. screws, that pass through the reflex sight body and into the mounting element to secure the reflex sight to the mounting element.

The mounting element may include a retention mechanism for retaining the mounting element, and mounted reflex sight, into the adapter shoe. The retention mechanism may be selectively releasable to allow the mounting element and sight to be removed from the slider. The retention mechanism includes push buttons 874, 876 and a retention element 872 that are disposed within a channel 880 within the body of the mounting element 840. The retention mechanism will be further described with reference to FIGS. 13 to 14 which show perspective views of the mounting element 840 with the retention mechanism in an extended and a retracted configuration respectively.

In one embodiment, the mounting element body may include an internal channel 880 that is located toward the forward end of the mounting element 840. The internal channel 840 may extend laterally through the body from a first opening 902 on a first side of the mounting element to a second opening on a second side of the mounting element. A forward channel may extend from a forward opening 912 to join with the lateral channel 880 within the body of the mounting element. The channel is closed on the underneath side of the mounting element but is open at the top surface to allow assembly of the push button components to be described.

The retention mechanism may include a push button assembly that causes a forward retention element 872 to engage the notch 835 provided in the adapter shoe. The retention element is a T-piece profiled to move within the forward channel with a T-stem 916 that projects from the forward opening 912. The T-piece retention element includes a shoulder 918 that abuts an inner surface of the forward channel to limit the range of movement of the retention element. The rearward surface 920 of the retention element slopes inwardly in the direction from each rear corner toward the longitudinal axis of the retention element.

The push button assembly includes a first side button 874 and a second side button 876. The side buttons may be inserted into the lateral channel and slide laterally within the channel. Distal ends 914 of the first and second buttons projects outward from the respective first and second openings 902. The forward edges of the push buttons have a sloping surface 926 that matches the sloping rear surface 920 of the retention element 872. A spring 890 may be provided between the inner surfaces of the buttons to bias the buttons apart. A hole in the inner side walls of the push buttons may optionally be provided to facilitate locating and retention of the spring.

The spring 890 biases each of the buttons outwards. As the buttons 874, 876 move outwards under the action of the spring 890, their sloping forward surfaces 926 slide along the sloping rear surface 920 of the retention element 872, thereby urging the retention element 872 forward to an extended position in which the forward end of the retention mechanism protrudes from the forward opening.

Figure 13:
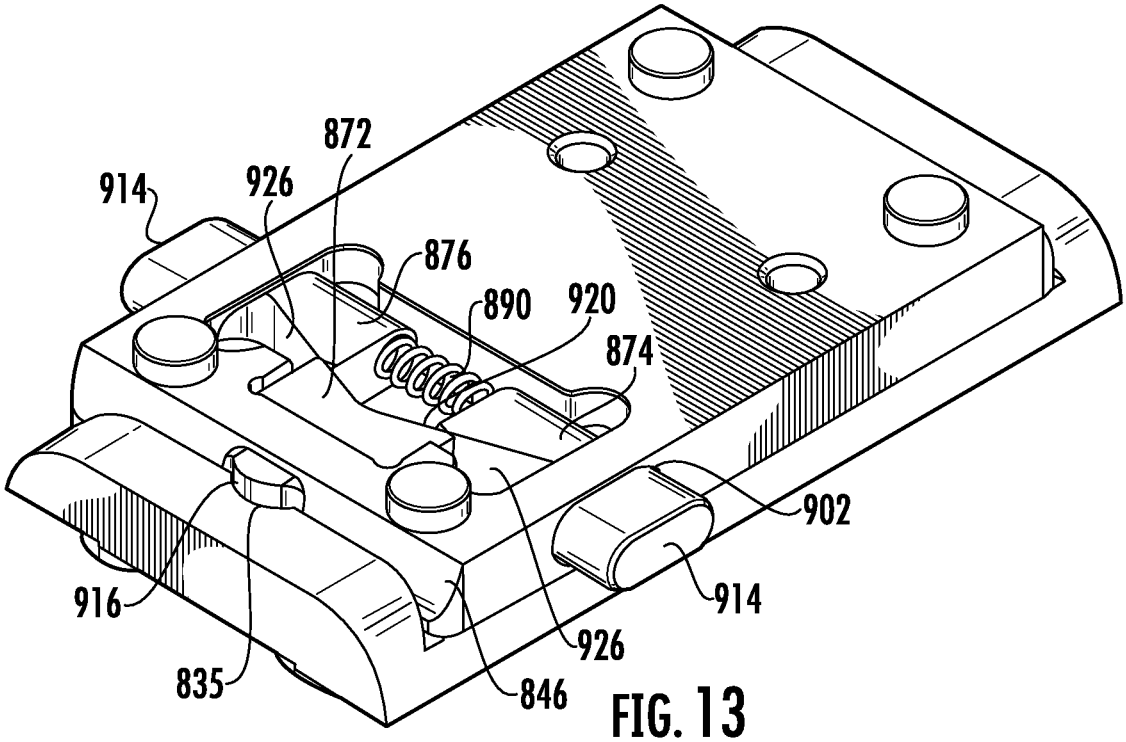
FIG. 13 substantially shows an extended or retention configuration of a retention mechanism.
Figure 14:
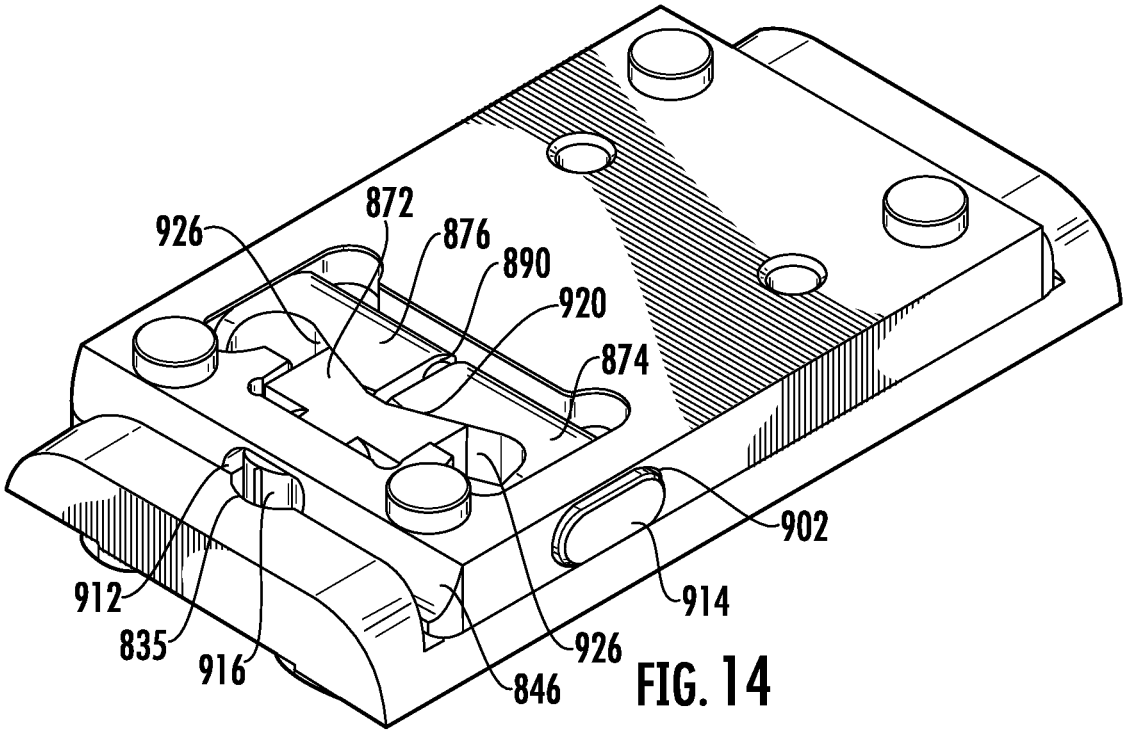
FIG. 14 substantially shows a retracted or unlocked configuration of the retention mechanism.

FIG. 13 shows the assembled mounting element installed in the adapter shoe. The handgun, slider and reflex sight are omitted for clarity. In FIG. 13, the mounting element is fully installed into the adapter shoe. The buttons 874, 876 are outwardly extended which urges the retention element 872 forward into the notch 835. The engagement between the retention element 872 and the notch 835 retains the mounting element in the adapter shoe and prevents the mounting element moving laterally in the dovetail track of the adapter shoe. FIG. 14 shows the arrangement when the buttons 874, 876 have been pressed inwards. This allows the retention element 872 to retract from the notch 835 thereby freeing the mounting element to move laterally within the dovetail track and thus be removed from the adapter shoe.

In one embodiment, the retention element has no separate biasing spring or similar. The front end of the retention element is rounded to match the contour of the notch. With the buttons pressed inward, the retention element is free to retract and the rounded nature of the retention element end means that the retention element will naturally retract when an attempt is made to slide the mounting element laterally within the dovetail track of the adapter shoe. When the buttons are released, the outward biasing of the buttons provided by the spring 890 biases the retention element forward.

In an alternative embodiment, one or more springs or similar biasing mechanisms may be placed between the shoulder of the retention element and the front inner wall of the channel of the mounting element. These springs may bias the T-piece to the retracted position so that as the buttons are pressed to allow the T-Piece freedom to move longitudinally, the T-piece will naturally move to the retracted position. However, the strength of the bias should not be sufficient to overcome the biasing of the push buttons to their outward positions when finger pressure on the buttons is released.

Figure 15:
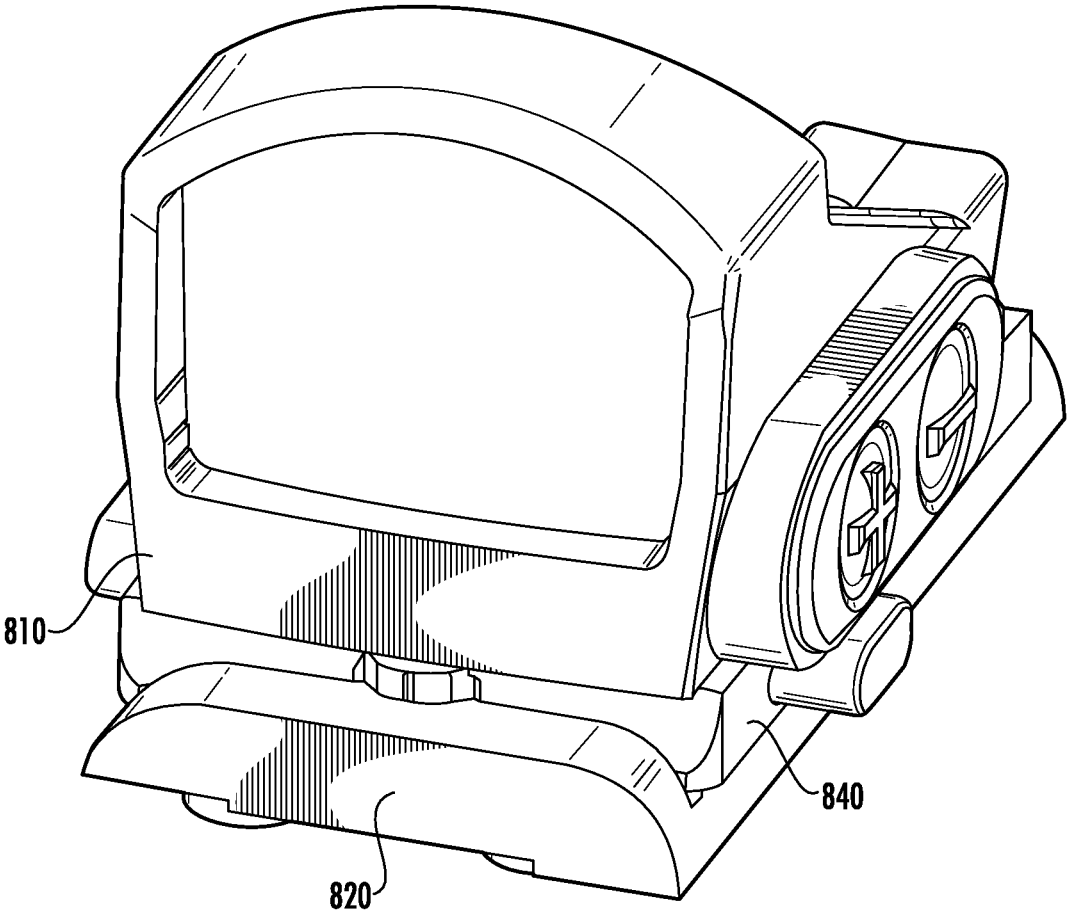
FIG. 15 substantially shows a reflex sight assembly installed within an adapter shoe.

FIG. 15 shows a similar view to FIG. 13 with the entire reflex sight assembly (i.e. reflex sight 810 and mounting element 840) installed into the adapter shoe 820.

The adapter shoe has the advantage of being able to be specifically customized to the design of the mounting element of the reflex sight.

The mounting element with a push button retention mechanism allows single handed removal of the reflex sight assembly that is simple and intuitive. The quick removal of the reflex sight assembly, without tools, means that batteries can be changed quickly when required and the configuration of the handgun can be readily adapter to suit the particular user's needs at that time.

The lower surface of the mounting element and the upper surface of the recess of the adapter shoe may both be flat so that one substantially abuts the other in use. Alternatively, these adjacent surfaces may include complementary features, such as lateral ribs and channels that can be used to laterally guide the mounting element into the adapter shoe.

The sight/slider interface described in various embodiments herein provides a secure method for inserting and removing a reflex sight to/from the body of a slider. In particular embodiments, the sight may be inserted and removed from the slider without tools whilst still ensuring firm retention during operation of the firearm. By providing a form factor that fits tightly into a slider recess and/or an adapter shoe, the mounting elements of the sight are able to absorb the acceleration energy across a larger surface by means of force closure.

Although the description above contains many specifications, these should not be construed as limiting the scope of the invention but as merely providing illustrations of some of the embodiments of this invention. Thus, the scope of the invention should be determined by the appended claims and their legal equivalents rather than by the examples given.

What is claimed is:

1. A reflex sighting system removably mountable to a slider of a handgun, the reflex sight comprising:

(A) a lens;

(B) a light source;

(C) a battery for powering the light source;

(D) electronics for controlling the operation of the light source; and (E) a housing that houses one or more of the battery and the electronics;

(F) a mounting element that is configured to mount the reflex sight to the slider, the mounting element comprising:

(a) a sight mounting component comprising:

(i) a sight mounting surface on which the reflex sight may be mounted and secured; and (ii) a first complementary lateral dovetail engagement feature;

(b) an adapter shoe comprising:

(i) a first mounting portion for mounting the adapter shoe to the slider; and (ii) a second mounting portion comprising a second complementary lateral dovetail engagement feature that is complementary to the first complementary lateral dovetail engagement feature;

wherein the first complementary lateral dovetail engagement feature and the second complementary lateral dovetail engagement feature each comprise a dovetail profile and wherein the sight mounting portion is configured to slide laterally along a dovetail track provided by the adapter shoe.

2. The reflex sighting system of claim 1 wherein the first mounting portion comprises an outer mounting element configured to be mounted into a recess of the slider.

3. The reflex sighting system of claim 1 comprising one or more fasteners for securing the adapter shoe to the slider.

4. The reflex sighting system of claim 1 comprising a retention mechanism for retaining the sight mounting component to the adapter shoe.

5. The reflex sighting system of claim 4 wherein the retention mechanism can be operated without tools to cause removal of the sight mounting component from the adapter shoe.

6. The reflex sighting system of claim 4 wherein the retention mechanism comprises one or more hand operated actuators that, when actuated, allow the sight mounting component to be released from the adapter shoe.

7. The reflex sighting system of claim 4 wherein the adapter shoe comprises a notch that engages the retention mechanism.

8. The reflex sighting system of claim 1 wherein the first mounting portion is configured to be mounted within a recess of the slider.

9. A method for mounting a reflex sight to a handgun comprising:

(A) securing an adapter shoe to a slider of the handgun, the adapter shoe comprising:

(a) a first mounting portion for mounting the adapter shoe to the slider; and (b) a second mounting portion comprising a first complementary engagement feature;

(B) moving a reflex sight assembly comprising the reflex sight into engagement with the adapter shoe, the moving comprising engaging the first complementary engagement feature with a second complementary engagement feature of the reflex sight assembly that is complementary to the first complementary engagement feature;

wherein the first complementary engagement feature and the second complementary engagement feature each comprise a dovetail profile and wherein the moving comprises sliding the reflex sight assembly laterally along a dovetail track provided by the adapter shoe.

10. The method of claim 9 comprising securing the adapter shoe into a recess of the slider with one or more fasteners.

11. The method of claim 9 comprising retaining the reflex sight assembly to the adapter shoe with a retention mechanism that is actuatable without tools to disengage the retention mechanism from the adapter shoe to allow the reflex sight assembly to be removed from the adapter shoe while the adapter shoe is secured to the slider.

12. The method of claim 9 wherein the reflex sight assembly comprises a reflex sight and a mounting element comprising the second complementary engagement feature, the method comprising securing the reflex sight to the mounting element with one or more fasteners.

* * * * *